US007255894B2

(12) United States Patent
Nguyen et al.

(10) Patent No.: US 7,255,894 B2
(45) Date of Patent: Aug. 14, 2007

(54) NON-CARBON ANODES FOR ALUMINIUM ELECTROWINNING AND OTHER OXIDATION RESISTANT COMPONENTS WITH SLURRY-APPLIED COATINGS

(75) Inventors: Thinh T. Nguyen, Onex (CH); Vittorio De Nora, Nassau (BS)

(73) Assignee: Moltech Invent S.A., Luxembourg (LU)

( * ) Notice: Subject to any disclaimer, the term of this patent is extended or adjusted under 35 U.S.C. 154(b) by 527 days.

(21) Appl. No.: 10/506,202

(22) PCT Filed: Apr. 15, 2003

(86) PCT No.: PCT/IB03/01479

§ 371 (c)(1),
(2), (4) Date: Aug. 31, 2004

(87) PCT Pub. No.: WO03/087435

PCT Pub. Date: Oct. 23, 2003

(65) Prior Publication Data

US 2005/0178658 A1 Aug. 18, 2005

(30) Foreign Application Priority Data

Apr. 16, 2002 (WO) ..... PCT/IB02/01239
Jul. 23, 2002 (WO) ..... PCT/IB02/02973

(51) Int. Cl.
*B05D 3/00* (2006.01)

(52) U.S. Cl. ..... 427/190; 427/189; 427/77; 427/126.1; 427/126.3; 427/180; 427/331; 204/290.01; 204/290.04; 204/290.1; 204/290.12; 204/290.13; 204/291; 205/372; 205/384; 205/385; 205/387

(58) Field of Classification Search ..... 427/77, 427/126.1, 126.3, 180, 189, 190; 204/290.01, 204/290.04, 290.1, 290.13, 290.12, 291; 205/372, 384, 385, 387
See application file for complete search history.

(56) References Cited

U.S. PATENT DOCUMENTS

| | | | | |
|---|---|---|---|---|
| 4,039,401 | A * | 8/1977 | Yamada et al. | 205/384 |
| 4,173,518 | A * | 11/1979 | Yamada et al. | 205/384 |
| 4,374,050 | A * | 2/1983 | Ray | 252/516 |
| 4,374,761 | A * | 2/1983 | Ray | 252/512 |
| 4,956,069 | A * | 9/1990 | Salazar | 204/257 |
| 4,960,494 | A * | 10/1990 | Nguyen et al. | 205/384 |
| 5,069,771 | A * | 12/1991 | Nguyen et al. | 204/292 |
| 6,077,415 | A * | 6/2000 | Duruz et al. | 205/384 |
| 6,103,090 | A * | 8/2000 | de Nora et al. | 205/384 |
| 6,113,758 | A * | 9/2000 | de Nora et al. | 204/284 |
| 6,248,227 | B1 * | 6/2001 | de Nora et al. | 205/230 |
| 2006/0011490 | A1 * | 1/2006 | Nguyen et al. | 205/372 |

* cited by examiner

*Primary Examiner*—Bruce F. Bell
(74) *Attorney, Agent, or Firm*—Jayadeep R Deshmukh

(57) ABSTRACT

A method of manufacturing a component, in particular an aluminium electrowinning anode, for use at elevated temperature in an oxidising and/or corrosive environment comprises: applying onto a metal-based substrate layers of a particle mixture containing iron oxide particles and particles of a reactant-oxide selected from titanium, yttrium, ytterbium and tantalum oxides; and heat treating the applied layers to consolidate by reactive sintering of the iron oxide particles and the reactant-oxide particles to turn the applied layer into a protective coating made of a substantially continuous reacted oxide matrix of one or more multiple oxides of iron and the metal from the reactant-oxide. The metal-based substrate comprises at its surface during the heat treatment an integral anchorage-oxide of at least one metal of the substrate. The anchorage-oxide anchors the multiple oxide matrix to the substrate by reacting with the iron oxide and/or the reactant-oxide to form an integral multiple bonding oxide of the metal of the integral anchorage-oxide and iron from the iron oxide and/or the metal of the reactant-oxide. The particle mixture can be applied in a colloidal and/or polymeric slurry.

42 Claims, No Drawings

NON-CARBON ANODES FOR ALUMINIUM ELECTROWINNING AND OTHER OXIDATION RESISTANT COMPONENTS WITH SLURRY-APPLIED COATINGS

FIELD OF THE INVENTION

This invention relates to a method of manufacturing non-carbon anodes for use in aluminium electrowinning cells as well as other oxidation resistant components.

BACKGROUND ART

Using non-carbon anodes for the electrowinning of aluminium should drastically improve the aluminium production process by reducing pollution and the cost of aluminium production. Many attempts have been made to use oxide anodes, cermet anodes and metal-based anodes for aluminium production, however they were never adopted by the aluminium industry.

For the dissolution of the raw material, usually alumina, a highly aggressive fluoride-containing electrolyte, typically based on cryolite, is required.

The materials having the greatest resistance to oxidation are metal oxides which are all to some extent soluble in cryolite. Oxides are also poorly electrically conductive, therefore, to avoid substantial ohmic losses and high cell voltages, the use of oxides should be minimal in the manufacture of anodes. Whenever possible, a good conductive material should be utilised for the anode core, whereas the surface of the anode is preferably made of an oxide having a high electrocatalytic activity.

Several patents disclose the use of an electrically conductive metal anode core with an oxide-based active outer part, in particular U.S. Pat. Nos. 4,956,069, 4,960,494, 5,069,771 (all Nguyen/Lazouni/Doan), U.S. Pat. No. 6,077,415 (Duruz/de Nora), U.S. Pat. No. 6,103,090 (de Nora), U.S. Pat. No. 6,113,758 (de Nora/Duruz) and U.S. Pat. No. 6,248,227 (de Nora/Duruz), as well as PCT publications WO00/06803 (Duruz/de Nora/Crottaz), WO00/06804 (Crottaz/Duruz), WO00/40783 (de Nora/Duruz), WO01/42534 (de Nora/Duruz) and WO01/42536 (Nguyen/Duruz/de Nora).

U.S. Pat. Nos. 4,039,401 and 4,173,518 (both Yamada/Hashimoto/Horinouchi) disclose multiple oxides for use as electrochemically active anode material for aluminium electrowinning. The multiple oxides inter-alia include oxides of iron, titanium and yttrium, such as $NiFe_2O_4$ or $TiFe_2O_4$, in the '401 patent, and oxides of yttrium, iron, titanium and tantalum, such as $Fe_2O_3.Ta_2O_5$, in the '518 patent. The multiple oxides are produced by sintering their constitutive single oxides. The sintered oxides are then crushed and applied onto a metal substrate (titanium, nickel or copper) by spraying or dipping. Alternatively, the multiple oxides can be produced by electroplating onto the metal substrate the constitutive metals of the multiple oxides followed by an oxidation treatment.

Likewise U.S. Pat. Nos. 4,374,050 and 4,374,761 (both Ray) disclose non-stoichiometric multiple oxides for use as electrochemically active anode material for aluminium electrowinning. The multiple oxides inter-alia include oxides of nickel, titanium, tantalum, yttrium and iron, in particular nickel-iron oxides. The multiple oxides are produced by sintering their constitutive single oxides and then they can be cladded onto an metal substrate.

WO99/36591 (de Nora), WO99/36593 and WO99/36594 (both Duruz/de Nora) disclose sintered multiple oxide coatings applied onto a metal substrate from a slurry containing particulate of the multiple oxides in a colloidal and/or inorganic polymeric binder, in particular colloidal or polymeric alumina, ceria, lithia, magnesia, silica, thoria, yttria, zirconia, tin oxide or zinc oxide. The multiple oxides include ferrites of cobalt, copper, chromium, manganese, nickel and zinc. It is inter-alia mentioned that the coating can be obtained by reacting precursors thereof among themselves or, alternatively, with constituents of the substrate.

These non-carbon anodes have not as yet been commercially and industrially applied and there is still a need for metal-based anodes for aluminium production.

SUMMARY OF THE INVENTION

The present invention concerns a method of manufacturing a component for use at elevated temperature in an oxidising and/or corrosive environment, in particular in a cell for the electrowinning of aluminium. The method comprises: applying onto a metal-based substrate one or more layers of a particle mixture containing iron oxide particles and particles of one or more reactant-oxide(s) of at least one metal selected from titanium, yttrium, ytterbium and tantalum; and heat treating the applied layers to consolidate by reactive sintering of the iron oxide particles and the reactant-oxide particles to turn the applied layer(s) into a protective coating made of a substantially continuous reacted oxide matrix of one or more multiple oxides of iron and the metal(s) of the metal reactant-oxide(s).

The metal-based substrate comprises at its surface during the heat treatment one or more integral anchorage-oxides of at least one metal of the substrate, the anchorage-oxide(s) anchoring the multiple oxide matrix to the substrate by reacting with the iron oxide and/or the reactant-oxide(s) to form an integral multiple bonding oxide of the metal(s) of the integral anchorage-oxide(s) and iron from the iron oxide and/or the metal(s) of the reactant-oxide(s).

In other words, an integral anchorage-oxide layer is formed by oxidising the surface of the substrate before and/or during the heat treatment. During the heat treatment, the anchorage oxide layer reacts with the iron oxide and/or the reactant-oxide(s) of the particle mixture to anchor the oxide matrix to the substrate by forming therebetween an integral multiple bonding oxide of the metal(s) of the integral anchorage-oxide layer and iron from the iron oxide and/or the metal(s) of the reactant-oxide(s).

The protective coating of the invention inhibits on the one hand diffusion from the substrate, e.g. dissolution of the substrate in a liquid environment and, on the other hand, diffusion into the substrate, in particular from an aggressive environment, such as oxygen from the atmosphere or fluorine (and/or fluorides) from a molten fluoride-based electrolyte.

Typically, the component of the invention is a component of an aluminium electrowinning cell, in particular a current carrying anodic component such as an active anode structure or an anode stem, or another cell component exposed to molten electrolyte and/or cell fumes, such as a cell cover or an alumina feeder. Examples of such cell components are disclosed in WO00/40781 and WO00/40782 (both de Nora), WO00/63464 (de Nora/Berclaz), WO01/31088 (de Nora), WO02/070784 (de Nora/Berclaz), WO03/006716 (de Nora) and WO03/006717 (Berclaz/Duruz). The applied layers on such cell components can be consolidated before use by heat treating the components over a cell.

The anchored multiple oxide matrix of the coating protects the substrate and inhibits its oxidation by the environment during use as well as metal diffusion from the substrate.

At least part of the anchorage-oxide(s) can be formed by oxidising the surface of the substrate that contains the metal(s) of the anchorage-oxide(s) before and/or after applying the particle mixture thereon.

The substrate contains the metal(s) of the (surface oxidation-produced) anchorage-oxide(s) that can react with the iron oxide and/or the reactant-oxide(s), i.e. oxides of titanium, yttrium, ytterbium and tantalum. The metal producing the anchorage-oxide can be present as such or in an alloy. In addition to the metal of the anchorage-oxide, such an alloy can contain a metal whose oxide is reactable neither with the iron oxide nor with the reactant-oxide of the particle mixture, as long as a suitable integral anchorage-oxide forms by surface oxidation of the substrate.

Such an alloy can also contain minor amounts of non-metals and/or compounds thereof, in particular one or more constituent selected from elemental and compounds of boron, carbon, oxygen, silicon, phosphorous and sulphur.

Advantageously, at least an outer part of the substrate contains iron that forms an integral anchorage-oxide of iron that can react with the reactant-oxide(s) during the heat treatment. The substrate can be made of iron or an iron-alloy, for example an iron alloy with nickel and/or cobalt optionally containing copper and/or aluminium and possible minor elements, e.g. as disclosed in WO00/06803 (Duruz/de Nora/Crottaz), WO00/06804 (Crottaz/Duruz), WO01/42534 (de Nora/Duruz), WO01/42536 (Duruz/Nguyen/de Nora), WO02/083991 (Nguyen/de Nora), WO03/014420 (Nguyen/Duruz/de Nora) and PCT/IB03/00964 (Nguyen/de Nora).

Other metals can be used in the substrate as a source for the anchorage-oxides as described hereafter.

For example, when the particle mixture contains titanium oxide as a reactant-oxide, the integral anchorage-oxide can comprise an oxide reactable therewith selected from oxides of magnesium, manganese, cobalt, nickel, zinc, yttrium, niobium, lanthanum and tantalum, for forming a multiple oxide with titanium.

When the particle mixture contains yttrium oxide as a reactant-oxide, the integral anchorage-oxide can comprise an oxide reactable therewith selected from oxides of titanium, chromium, manganese, germanium, zirconium, niobium, ruthenium, tin, lanthanum, hafnium, tantalum, osmium and iridium, for forming a multiple oxide with yttrium.

Furthermore, when the particle mixture contains ytterbium oxide as a reactant-oxide, the integral anchorage-oxide may comprises an oxide reactable therewith selected from oxides of chromium, manganese, indium and aluminium, for forming a multiple oxide with ytterbium.

Finally, when the particle mixture contains tantalum oxide as a reactant-oxide, the integral anchorage-oxide can comprise at least one oxide reactable therewith selected from oxides of lithium, aluminium, chromium, cobalt, nickel, zinc, yttrium, zirconium, palladium, silver, indium, tin, lanthanum and bismuth, for forming a multiple oxide with tantalum.

The substrate may also contain a metal that forms an anchorage-oxide that can react with the iron oxide particles of the particle mixture. Metal oxides that are reactable with iron oxide include oxides of magnesium, aluminium, vanadium, chromium, manganese, cobalt, nickel, copper, zinc, yttrium, indium, tantalum, titanium and ytterbium.

The iron oxide particles and the reactant-oxide particles preferably comprise particles that are sufficiently large, i.e. at least one micron, so that the applied layers reach a thickness of at least a dozen microns. On the other hand, the particles should be sufficiently small so that, under the heat treatment conditions, they completely react with one another to form the multiple oxide matrix. Typically, the particles are smaller than 75 micron, preferably smaller than 50 micron, in particular the particles may be no larger than a maximum size in the range from 5 to 45 micron.

The properties of the protective coating can be enhanced by adding further constituents to the particle mixture. For instance, the particle mixture can contain particles of copper oxide (and/or copper metal that is oxidised during heat treatment) that react with iron oxide particles during the heat treatment to form a plastic and conductive iron-copper double oxide.

The particle mixture can further comprise at least one substantially non-oxidisable metal selected from Ag, Ir, Pd, Pt and Rh forming a metallic phase in the protective coating.

Moreover, the particle mixture can contain one or more metals selected from Fe, Cu, Co, Cr, Al, Ga, Ge, Hf, In, Mo, Mn, Os, Re, Se, Ti, Ta, V, W, Zr, Li, Ca, Ce, Nb, Ru, Si, Sn, Zn, Mischmetals and metals of the Lanthanide series, and alloys thereof. Some of these metals may remain as a metallic phase in the protective coating if the reactive-sintering heat treatment is carried out in a substantially inert atmosphere. Alternatively, when the reactive-sintering heat treatment is carried out in an oxidising atmosphere, such metals are oxidised, which causes a volume expansion thereof that compensates at least partly a volume contraction caused by the reactive formation of the multiple oxide from the particles of iron oxide and the reactant-oxide(s).

The particle mixtures may further comprise minor amounts of at least one dopant or a precursor thereof that dopes the multiple oxides of the matrix upon the heat treatment. For example, the multiple oxides matrix comprises one or more dopants selected from $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

Furthermore, the particle mixture can further comprise minor amounts of at least one electrocatalyst selected from iridium, palladium, platinum, rhodium, ruthenium, silicon, tin and zinc metals, Mischmetals and metals of the Lanthanide series, and compounds thereof, in particular oxides and oxyfluorides.

In one embodiment of the invention, the particle mixtures is applied in a slurry that contains the particles of iron oxide and of the reactant-oxide(s).

The slurry can contain a suspension of the particles of iron oxide and of the reactant-oxide(s) in an organic/inorganic colloidal and/or organic/inorganic polymeric carrier.

The colloidal and/or polymeric carrier may contain dispersed particles which can have at least one dimension, preferably two or all dimensions, in the range from 0.5 to 1000 nanometer, in particular from 5 to 100 nanometer.

The inorganic colloidal and/or inorganic polymeric particles can be compounds, in particular oxides, hydroxides, nitrates, acetates and formates, of at least one metal, for example particles of at least one of colloidal and polymeric compounds, in particular oxides, hydroxides, nitrates, acetates and formates, of silicon, aluminium, yttrium, cerium, thorium, zirconium, magnesium and lithium. Preferably, the colloidal and/or polymeric particles consist of compounds reactable during the heat treatment with iron oxide and/or the reactant-oxide to produce a multiple metal oxide. such reactable compounds include compounds of the metals of the above listed metal oxides that are reactable with the reactant-oxides, i.e. the oxides of titanium, yttrium, ytterbium and tantalum.

Further details of suitable inorganic colloidal and/or inorganic polymeric carriers are disclosed in U.S. Pat. No. 5,651,874 and WO99/36593.

The slurry can contain an organic carbon compound as a binder and/or as an agent to modify the Theological characteristics of the slurry, in particular for the application of thicker protective coatings. Such a compound can be in the form of an organic carbon polymer and/or colloid, having a hydrophilic substituent, in particular a substituent selected from —OH, —$SO_3Na$ and —COOH. The carbon compound may have a carbon/hydrophilic substituent ratio in the range of 2 to 4. For example, the carbon compound is selected from ethylene glycol, hexanol, polyvinyl alcohol, polyvinyl acetate, polyacrylic acid, hydroxy propyl methyl cellulose and ammonium polymethacrylate.

The particle mixture can also be applied onto the substrate by plasma spraying or other known application techniques.

Usually, the particle mixture is consolidated on the substrate by heat treatment at a temperature in the range from 700° to 1100° C., in particular from 850° to 950° C.

The heat treatment for consolidating the powder mixture on the substrate can last from 1 to 48 hours, in particular from 5 to 24 hours, depending on the composition of the powder mixture and the temperature of the treatment.

Especially when the integral anchorage-oxide is (further) formed at the substrate's surface during the heat treatment for consolidating the particle mixture, the heat treatment should be carried out in an oxidising atmosphere, typically containing 10 to 100 mol % $O_2$.

The invention also concerns a method of electrowinning aluminium. The method comprises manufacturing a current-carrying anodic component having an iron-containing mixed oxide matrix coating by the above described method, installing the anodic component in a molten electrolyte containing dissolved alumina and passing an electrolysis current from the anodic component to a facing cathode in the molten electrolyte to evolve oxygen anodically and produce aluminium cathodically.

Usually, the electrolyte is a fluoride-based molten electrolyte, in particular containing fluorides of aluminium and sodium. The electrolyte can be at a temperature in the range from 800° to 960° C., in particular from 880° to 940° C.

Advantageously, an alumina concentration which is at or close to saturation can be maintained in the electrolyte, particularly adjacent the anodic component, to reduce the solubility of metal species in the electrolyte, in particular of metal species present as one or more oxides at the surface of the anodic component. Systems for maintaining a high concentration of alumina near anodic components are disclosed in WO99/41429 (de Nora/Duruz), WO99/41430 (Duruz/Bellò), WO00/40781 and WO00/40782 (both de Nora), WO00/63464 (de Nora/Berclaz) and WO01/31088 and WO03/023092 (both de Nora).

Alternatively or cumulatively, an amount of iron species can be maintained in the electrolyte to inhibit dissolution of the iron-containing mixed oxide matrix coating of the anodic component, as for example disclosed in WO00/06802 (Duruz/de Nora/Crottaz).

Another aspect of the invention relates to a method of electrowinning aluminium. The method comprises: manufacturing a cover having a mixed oxide matrix coating by the above described method; placing the cover over an aluminium production cell trough containing a molten electrolyte in which alumina is dissolved; passing an electrolysis current in the molten electrolyte to evolve oxygen anodically and aluminium cathodically; and confining electrolyte vapours and evolved oxygen within the cell trough by means of the mixed oxide matrix of the cover.

A further aspect of the invention relates to component for use at elevated temperature in an oxidising and/or corrosive environment, in particular in a cell for the electrowinning of aluminium. The component comprises a metal-based substrate coated with a substantially continuous oxide matrix of one or more multiple oxides of iron and at least one metal selected from titanium, yttrium, ytterbium and tantalum, anchored to the substrate by a bonding oxide layer of a multiple oxide of at least one metal of the substrate and at least one metal of the oxide matrix, the multiple oxide matrix being producible by reacting single oxides of metals of the multiple oxide(s) of the matrix. The multiple oxide matrix is bonded to the substrate by the bonding oxide layer that is producible by reacting at least one of said single oxides with an anchorage-oxide which is integral with the metal-based substrate and formed by surface oxidation thereof.

Yet another aspect of the invention relates to a cell for the electrowinning of aluminium comprising at least one component as described above.

DETAILED DESCRIPTION

The invention will be further described and illustrate by comparison in the following Examples:

COMPARATIVE EXAMPLE

An anode was prepared and tested as disclosed in PCT/IB03/00964 (Nguyen/de Nora).

The anode was manufactured from an anode rod of diameter 20 mm and total length 20 mm made of a cast alloy containing 69 weight % iron, 22 weight % nickel, 6 weight % copper and 3 weight % aluminium. The anode rod was supported by a stem made of an alloy containing nickel, chromium and iron, such as Inconel, protected with an alumina sleeve.

The anode was suspended for 16 hours over a molten cryolite-based electrolyte at 925° C. whereby its surface was oxidised.

Electrolysis was carried out by fully immersing the anode rod in the molten electrolyte. The electrolyte contained 18 weight % aluminium fluoride ($AlF_3$), 6.5 weight % alumina ($Al_2O_3$), 4 weight % calcium fluoride ($CaF_2$), the balance being cryolite ($Na_3AlF_6$).

The current density was about 0.8 A/cm$^2$ and the cell voltage was at 3.5-3.8 volt throughout the test. The concentration of dissolved alumina in the electrolyte was maintained during the entire electrolysis by periodically feeding fresh alumina into the cell.

After 50 hours electrolysis was interrupted and the anode extracted. Upon cooling the anode was examined externally and in cross-section.

The anode's outer dimensions had remained substantially unchanged. The anode's oxide outer part had grown from an initial thickness of about 70 micron to a thickness after use of about up to 500 micron.

EXAMPLE 1

An aluminium electrowinning anode was prepared according to the invention as follows:

A slurry for coating an anode substrate was prepared by suspending a particle mixture of $Fe_2O_3$ particles (−325 mesh, i.e. smaller than 44 micron) and $TiO_2$ particles (−325 mesh) in colloidal alumina (NYACOL® Al-20, a milky liquid with a colloidal particle size of about 40 to 60 nanometer and containing 20 weight % colloidal particle and 80 weight % liquid solution) in a weight ratio $Fe_2O_3$:$TiO_2$:colloid of 40:20:40. The pH of the slurry was adjusted at 4 by adding a few drops of $HNO_3$ to avoid gelling of the slurry.

An anode substrate consisting of a cast alloy having the same composition as the cast alloy of the Comparative Example was covered with two layers of this slurry that were applied thereon with a brush. The applied layers were consolidated by reactive sintering of the iron oxide and the titanium oxide by a heat treatment at 950° C. in air for 24 hours to form a protective coating on the anode substrate.

The coated anode substrate was allowed to cool down to room temperature and examined in cross-section. The coating had a thickness of about 125 to 150 micron. The coating was substantially continuous and thoroughly reacted thus forming a multiple oxide matrix of iron oxide, in particular $Fe_2O_3$, and titanium oxide, in particular $TiO_2$.

Underneath the coating, an integral oxide scale mainly of iron oxide had grown from the substrate during the heat treatment and reacted with titanium oxide from the coating to firmly anchor the coating to the substrate. The reacted integral oxide scale contained titanium oxide in an amount of about 10 metal weight %. Minor amounts of copper, aluminium and nickel were also found in the oxide scale (less that 5 metal weight % in total).

EXAMPLE 2

An anode was prepared as in Example 1 by covering an iron-alloy substrate with layers of a colloidal slurry containing a particle mixture of $Fe_2O_3$ and $TiO_2$.

The applied layers were consolidated by suspending the anode for 16 hours over a cryolite-based electrolyte at 925° C. The electrolyte contained 18 weight % aluminium fluoride ($AlF_3$), 6.5 weight % alumina ($Al_2O_3$), 4 weight % calcium fluoride ($CaF_2$), the balance being cryolite ($Na_3AlF_6$).

Upon consolidation of the layers, the anode was immersed in the molten electrolyte and an electrolysis current passed from the anode to a facing cathode through the alumina-containing electrolyte to evolve oxygen anodically and produce aluminium cathodically. A high oxygen evolution was observed during the test. The current density was about 0.8 A/cm$^2$ and the cell voltage was stable at 3.0-3.1 volt throughout the test.

Compared to an uncoated anode as shown in the Comparative Example, coating an alloy-anode with a multiple oxide according to the invention led to an improvement of the anode performance such that the cell voltage was stabilised and also reduced by 0.4 to 0.8 volt, which corresponds to about 10 to 20%, thus permitting tremendous energy savings.

After 50 hours, the anode was extracted from the electrolyte and underwent cross-sectional examination.

The thickness of the coating after use (about 125 micron) had not significantly changed. The anchorage-oxide scale integral with the anode substrate had grown from an initial thickness of about 40 micron to a thickness after use of about 50 micron.

This shows that coating an alloy-anode with a multiple oxide according to the invention leads to a significant reduction of the oxidation rate of the anode alloy compared to the uncoated anode of the Comparative Example. This demonstrates that the inventive coating inhibits oxygen diffusion to the alloy during use.

EXAMPLE 3

Example 2 was repeated with different protective coatings.

A first slurry for coating an anode substrate was prepared by suspending a particle mixture of $Fe_2O_3$ particles (−325 mesh) and $Y_2O_3$ particles (−325 mesh) in colloidal alumina (NYACOL® Al-20) in a weight ratio $Fe_2O_3$:$Y_2O_3$:colloid of 25:35:40. The pH of the slurry was adjusted as in Example 2.

A second slurry for coating an anode substrate was prepared by suspending a particle mixture of $Fe_2O_3$ particles (−325 mesh) and $Ta_2O_5$ particles (−325 mesh) in colloidal alumina (NYACOL® Al-20) in a weight ratio $Fe_2O_3$:$Ta_2O_5$:colloid of 16:44:40. Again, the pH of the slurry was adjusted as in Example 2.

The slurries were applied onto anode substrates and consolidated and tested as in Example 2.

The test results were similar to those of Example 2. However, the cell voltage was similar to the cell voltage of the Comparative Example.

EXAMPLE 4

Example 2 was repeated with a protective coating containing copper oxide.

A slurry for coating an anode substrate was prepared by suspending a particle mixture of $Fe_2O_3$ particles (−325 mesh), $TiO_2$ particles (−325 mesh) and CuO particles in colloidal alumina (NYACOL® Al-20) in a weight ratio $Fe_2O_3$:$TiO_2$:CuO:colloid of 40:10:10:40. The pH of the slurry was adjusted as in Example 1.

The slurries were applied onto an anode substrate and consolidated over a molten cryolite-based electrolyte at 925° C. to form a protective coating as in Example 2.

Examination of a similar coated substrate showed that the coating was made of a mixture of iron oxide/copper oxide, in particular $Fe_2O_3$.CuO, and iron oxide/titanium oxide, in particular $Fe_2O_3$.$TiO_2$. The coating formed a thoroughly reacted oxide matrix which was denser than the copper-free coating of Example 1. An integral oxide scale mainly of iron oxide had grown from the substrate during the heat treatment and reacted with titanium oxide from the coating to firmly anchor the coating to the substrate as in Example 1.

Upon consolidation of the layers, the anode was immersed in the molten electrolyte and tested as in Example 2.

The test results were similar to those of Example 2.

EXAMPLE 5

Examples 1 to 4 were repeated by adding to the initial slurry 1-2 weight % of a solution containing 15% weight PVA. The addition of PVA improved the Theological characteristics of the slurry and permitted the application of thicker coatings, i.e. 200 to 300 micron thick, without formation of cracks during drying and/or heat treatment.

EXAMPLE 6

Examples 1 to 5 can be repeated using different metal alloy compositions for the anode substrate, in particular the anode alloy compositions disclosed in PCT/IB03/00964 (Nguyen/de Nora) and iron alloys described in the other references mentioned above, or a nickel-iron alloy composition (A-O) selected from Table I.

TABLE I

| | Ni | Fe | Co | Cu | Al | Y | Mn | Si | C |
|---|---|---|---|---|---|---|---|---|---|
| A | 48 | 38 | — | 10 | 3 | — | 0.5 | 0.45 | 0.05 |
| B | 49 | 40 | — | 7 | 3 | — | 0.5 | 0.45 | 0.05 |
| C | 36 | 50 | — | 10 | 3 | — | 0.5 | 0.45 | 0.05 |
| D | 36 | 50 | — | 10 | 3 | 0.35 | 0.3 | 0.3 | 0.05 |
| E | 36 | 53 | — | 7 | 3 | — | 0.5 | 0.45 | 0.05 |
| F | 36 | 53 | — | 7 | 3 | 0.35 | 0.3 | 0.3 | 0.05 |
| G | 48 | 38 | — | 10 | 3 | 0.35 | 0.3 | 0.3 | 0.05 |
| H | 22 | 68 | — | 5.5 | 4 | — | 0.25 | 0.2 | 0.05 |
| I | 42 | 42 | — | 12 | 2 | 1 | 0.5 | 0.45 | 0.05 |
| J | 42 | 40 | — | 12.5 | 4 | 0.4 | 0.45 | 0.6 | 0.05 |
| K | 45 | 44 | — | 7 | 3 | — | 0.5 | 0.45 | 0.05 |
| L | 30 | 69 | — | — | — | — | 0.5 | 0.45 | 0.05 |
| M | 25 | 65 | 7 | 1 | 1 | — | 0.5 | 0.45 | 0.05 |
| N | 59 | 40 | — | — | — | — | 0.5 | 0.45 | 0.05 |
| O | 50 | 47.4 | — | — | — | 1.7 | 0.35 | 0.5 | 0.05 |

The invention claimed is:

1. A method of manufacturing a component for use at elevated temperature in an oxidising and/or corrosive environment, in particular in a cell for the electrowinning of aluminium, comprising:

applying onto a metal-based substrate one or more layers of a particle mixture containing iron oxide particles and particles of one or more reactant-oxides of at least one metal selected from titanium, yttrium, ytterbium and tantalum; and heat treating the applied layers to consolidate by reactive sintering of the iron oxide particles and the reactant-oxide(s) particles to turn the applied layer(s) into a protective coating made of a substantially continuous reacted oxide matrix of one or more multiple oxides of iron and the metal(s) of the metal reactant-oxide(s), the metal-based substrate comprising at its surface during the heat treatment one or more integral anchorage-oxides of at least one metal of the substrate, the anchorage-oxide(s) anchoring the multiple oxide matrix to the substrate by reacting with the iron oxide particles and/or the reactant-oxide(s) particles to form an integral multiple bonding oxide of the metal(s) of the integral anchorage-oxide(s) and iron from the iron oxide and/or the metal(s) of the reactant-oxide(s).

2. The method of claim 1, comprising forming at least part of the anchorage-oxide(s) by oxidising the surface of the substrate that contains the metal(s) of the anchorage-oxide(s) before applying the particle mixture thereon.

3. The method of claim 1, comprising forming at least part of the anchorage-oxide(s) by oxidising or further oxidising the surface of the substrate after having applied the particle mixture thereon, in particular during the heat treatment.

4. The method of claim 1, wherein the substrate contains iron that forms upon oxidation an integral anchorage-oxide of iron for reacting with the reactant-oxide.

5. The method of claim 4, wherein the substrate has an outer part made of an iron alloy containing nickel and/or cobalt that forms by surface oxidation an integral anchorage-oxide consisting predominantly of iron oxide.

6. The method of claim 1, wherein the particle mixture contains titanium oxide as a reactant-oxide and the integral anchorage-oxide comprises at least one oxide selected from oxides of magnesium, manganese, cobalt, nickel, zinc, yttrium, niobium, lanthanum and tantalum, and mixtures thereof, that forms a multiple oxide with titanium.

7. The method of claim 1, wherein the particle mixture contains yttrium oxide as a reactant-oxide and the integral anchorage-oxide comprises at least one oxide selected from oxides of titanium, chromium, manganese, germanium, zirconium, niobium, ruthenium, tin, lanthanum, hafnium, tantalum, osmium and iridium, and mixtures thereof, that forms a multiple oxide with yttrium.

8. The method of claim 1, wherein the particle mixture contains ytterbium oxide as a reactant-oxide and the integral anchorage-oxide comprises at least one oxide selected from oxides of chromium, manganese, indium and aluminium, and mixtures thereof, that forms a multiple oxide with ytterbium.

9. The method of claim 1, wherein the particle mixture contains tantalum oxide as a reactant-oxide and the integral anchorage-oxide comprises at least one oxide selected from oxides of lithium, aluminium, chromium, cobalt, nickel, zinc, yttrium, zirconium, palladium, silver, indium, tin, lanthanum and bismuth, and mixtures thereof, that forms a multiple oxide with tantalum.

10. The method of claim 1, wherein the substrate contains at least one metal selected from magnesium, aluminium, vanadium, chromium, manganese, cobalt, nickel, copper, zinc, yttrium, indium, tantalum, titanium and ytterbium that forms an integral anchorage-oxide reactable with the iron oxide particles.

11. The method of claim 1, wherein the iron oxide particles and the reactant-oxide particles are smaller than 75, preferably smaller than 50 micron.

12. The method of claim 11, wherein the iron oxide particles and the reactant-oxide particles are no larger than a maximum size in the range from 5 to 45 micron.

13. The method of claim 1, wherein the particle mixture further comprises at least one substantially non-oxidisable metal selected from Ag, Ir, Pd, Pt and Rh forming a metallic phase in the protective coating.

14. The method of 13, wherein the particle mixture further comprises one or more metals selected from Fe, Cu, Co, Cr, Al, Ga, Ge, Hf, In, Mo, Mn, Os, Re, Se, Ti, Ta, V, W, Zr, Li, Ca, Ce, Nb, Ru, Si, Sn, Zn, Mischmetals and metals of the Lanthanide series, and alloys thereof, the reactive-sintering heat treatment being carried out in an oxidising atmosphere to oxidise into metal oxide(s) said one or more metals with a resulting volume expansion that compensates at least partly a volume contraction caused by the reactive formation of the multiple oxide from the particles of iron oxide and the reactant-oxide(s).

15. The method of claim 1, wherein the particle mixture further comprises one or more metals selected from Co, Ge, Hf, In, Os, Re, Ti, Ta, V, Zr, Nb, Ru, Mischmetals and metals of the Lanthanide series, and alloys thereof, the reactive-sintering heat treatment being carried out in a substantially inert atmosphere to maintain said one or more metals as a metallic phase in the protective coating.

16. The method of claim 1, wherein the particle mixture further comprises minor amounts of at least one dopant or precursor thereof that dopes the multiple oxides of the matrix upon the heat treatment.

17. The method of claim 16, wherein the multiple oxides matrix comprises one or more dopants selected from $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

18. The method of claim 17, wherein the particle mixture is applied onto the substrate by plasma spraying.

19. The method of claim 1, wherein the particle mixtures is applied in a slurry that contains the particles of iron oxide and of the reactant-oxide(s).

20. The method of claim 19, wherein the slurry contains a suspension of the particles of iron oxide and of the reactant-oxide(s) in a colloidal and/or polymeric carrier.

21. The method of claim 20, wherein the carrier comprises inorganic colloidal and/or inorganic particles of one or more compounds, in particular oxides, hydroxides, nitrates, acetates and formates.

22. The method of claim 20, wherein the carrier comprises inorganic colloidal and/or inorganic polymeric particles of at least one metal compound that is reactable during the heat treatment with iron oxide and/or the reactant-oxide to produce a multiple metal oxide.

23. The method of claim 22, wherein the carrier comprises particles of at least one of colloidal and polymeric compound, in particular hydroxides, nitrates, acetates and formates, of silicon, aluminium, yttrium, cerium, thorium, zirconium, magnesium, lithium.

24. The method of claim 23, wherein the slurry contains an organic carbon compound, in particular an organic carbon polymer and/or colloid, having a hydrophilic substituent.

25. The method of claim 24, wherein the hydrophilic substituent is selected from —OH, —$SO_3Na$ and —COOH.

26. The method of claim 24, wherein the organic carbon compound has/have a carbon/hydrophilic substituent ratio in the range of 2 to 4.

27. The method of claim 26, wherein the organic carbon compound is selected from ethylene glycol, hexanol, polyvinyl alcohol, polyvinyl acetate, polyacrylic acid, hydroxy propyl methyl cellulose and ammonium polymethacrylate.

28. The method of claim 1, wherein the particle mixture is consolidated on the substrate by heat treatment at a temperature in the range from 700° to 1100° C., in particular from 850° to 950° C.

29. The method of claim 1, wherein the particle mixture is consolidated on the substrate by heat treatment for 1 to 48 hours, in particular for 5 to 24 hours.

30. The method of claim 1, wherein the particle mixture is consolidated on the substrate by heat treatment in an atmosphere containing 10 to 100 mol % $O_2$.

31. The method of claim 1 for manufacturing a component of an aluminium electrowinning cell which during use is exposed to molten electrolyte and/or cell fumes.

32. The method of claim 31 for manufacturing a current carrying coated anodic component, in particular an active anode structure or an anode stem.

33. A method of electrowinning aluminium comprising manufacturing a current-carrying anodic component having said iron-containing mixed oxide matrix coating by the method of claim 32, installing the anodic component in a molten electrolyte containing dissolved alumina and passing an electrolysis current from the anodic component to a facing cathode in the molten electrolyte to evolve oxygen anodically and produce aluminium cathodically.

34. The method of claim 33, wherein the electrolyte is a fluoride-based molten electrolyte, in particular containing fluorides of aluminium and sodium.

35. The method of claim 33, comprising maintaining the electrolyte at a temperature in the range from 800° to 960° C., in particular from 880° to 940° C.

36. The method of claim 35, comprising maintaining in the electrolyte, particularly adjacent the anodic component, an alumina concentration which is at or close to saturation.

37. The method of claim 36, comprising maintaining an amount of iron species in the electrolyte to inhibit dissolution of the iron-containing mixed oxide matrix coating of the anodic component.

38. The method of claim 31 for manufacturing a coated cover.

39. The method of claim 38, comprising consolidating said applied layers by heat treating the cell component over the cell.

40. A method of electrowinning aluminium comprising manufacturing a cover by the method of claim 39 having a mixed oxide matrix coating, placing the cover over an aluminium production cell trough containing a molten electrolyte in which alumina is dissolved, passing an electrolysis current in the molten electrolyte to evolve oxygen anodically and aluminium cathodically and confining electrolyte vapours and evolved oxygen within the cell trough by means of the mixed oxide matrix of the cover.

41. A component for use at elevated temperature in an oxidising and/or corrosive environment, in particular in a cell for the electrowinning of aluminium, comprising a metal-based substrate coated with a substantially continuous oxide matrix of one or more multiple oxides of iron and at least one metal selected from titanium, yttrium, ytterbium and tantalum, anchored to the substrate by a bonding oxide layer of a multiple oxide of at least one metal of the substrate and at least one metal of the oxide matrix, the multiple oxide matrix being producible by reacting single oxides of metals of the multiple oxide(s) of the matrix and bonded to the substrate by the bonding oxide layer that is producible by reacting at least one of said single oxides with an anchorage-oxide which is integral with the metal-based substrate and formed by surface oxidation thereof.

42. A cell for the electrowinning of aluminium comprising at least one component as defined claim 41.

* * * * *